US009963270B2

(12) United States Patent
Murray

(10) Patent No.: US 9,963,270 B2
(45) Date of Patent: May 8, 2018

(54) POUCH WITH SMOOTH SIDES

(71) Applicant: Pouch Pac Innovations, LLC, Sarasota, FL (US)

(72) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 0 days. days.

(21) Appl. No.: 14/862,880

(22) Filed: Sep. 23, 2015

(65) Prior Publication Data

US 2016/0083145 A1 Mar. 24, 2016

Related U.S. Application Data

(63) Continuation-in-part of application No. 14/444,081, filed on Jul. 28, 2014.
(Continued)

(51) Int. Cl.

| | |
|---|---|
| ***B65D 33/00*** | (2006.01) |
| ***B65D 25/20*** | (2006.01) |
| ***B65D 75/00*** | (2006.01) |
| ***B65D 75/52*** | (2006.01) |
| ***B65D 75/58*** | (2006.01) |
| ***B31B 70/60*** | (2017.01) |

(Continued)

(52) U.S. Cl.
CPC ..... *B65D 25/205* (2013.01); *B31B 70/60* (2017.08); *B65D 75/008* (2013.01); *B65D 75/52* (2013.01); *B65D 75/525* (2013.01); *B65D 75/5883* (2013.01); *B31B 70/008* (2017.08); *B31B 70/844* (2017.08); *B31B 2150/00* (2017.08); *B31B 2150/002* (2017.08); *B31B 2160/20* (2017.08); *B31B 2170/20* (2017.08); *B65D 2203/02* (2013.01)

(58) Field of Classification Search
CPC ..... B65D 75/008; B65D 25/205
See application file for complete search history.

(56) References Cited

U.S. PATENT DOCUMENTS

| | | | |
|---|---|---|---|
| 3,307,738 | A | 3/1967 | Scheindel |
| 3,716,962 | A | 2/1973 | Langen et al. |

(Continued)

FOREIGN PATENT DOCUMENTS

| | | | |
|---|---|---|---|
| JP | 2001-270533 | A | 10/2001 |
| JP | 2012-192958 | A | 10/2012 |
| JP | 2013-132887 | A | 7/2013 |

OTHER PUBLICATIONS

International Search Report, PCT/US2014/048433 Wrtten Opinion, dated Nov. 28, 2014, Thirteen pages.

*Primary Examiner* — Derek Battisti
(74) *Attorney, Agent, or Firm* — Dinsmore & Shohl LLP

(57) ABSTRACT

The present invention relates to a container having consumer friendly sides. The container has a front panel and a back panel, each having an exterior surface. A side sealed portion of the container is folded over and secured to the exterior surface of container. The side sealed portion having at least one angled portion. Securing the side sealed portion to the exterior surface of the container forms a smooth side with the portion of the container that is folded over, or flexed, to allow the side sealed portion to be secured to the front or back panel. A method for forming the container assembly, and a machine for manufacturing the container assembly are also disclosed.

3 Claims, 12 Drawing Sheets

Related U.S. Application Data

(60) Provisional application No. 61/858,933, filed on Jul. 26, 2013.

(51) Int. Cl.

| | |
|---|---|
| *B31B 150/00* | (2017.01) |
| *B31B 160/20* | (2017.01) |
| *B31B 70/00* | (2017.01) |
| *B31B 70/84* | (2017.01) |
| *B31B 170/20* | (2017.01) |

(56) References Cited

U.S. PATENT DOCUMENTS

| | | | | |
|---|---|---|---|---|
| 3,935,993 | A | 2/1976 | Doyen et al. | |
| 4,232,048 | A | 11/1980 | Palm et al. | |
| 4,425,108 | A | 1/1984 | Harrison et al. | |
| 4,795,271 | A * | 1/1989 | Lane, Jr. | B65D 75/5822 229/308 |
| 4,942,948 | A * | 7/1990 | Vickers | A45C 3/10 190/1 |
| 5,971,613 | A | 10/1999 | Bell | |
| 6,095,960 | A * | 8/2000 | Achelpohl | B31B 29/60 493/189 |
| 6,199,601 | B1 | 3/2001 | Laudenberg | |
| 6,716,499 | B1 | 4/2004 | Vadhar | |
| 6,790,468 | B1 | 9/2004 | Mize, Jr. et al. | |
| 6,827,099 | B2 * | 12/2004 | Tanaka | B65B 7/08 137/255 |
| D628,902 | S | 12/2010 | Schroeder et al. | |
| 8,366,855 | B2 | 2/2013 | Murray | |
| 9,004,758 | B2 * | 4/2015 | Frayne | B31D 5/0073 206/522 |
| 2006/0062497 | A1 | 3/2006 | Murray | |
| 2012/0289391 | A1 | 11/2012 | Murray et al. | |
| 2013/0016925 | A1 | 1/2013 | Murray | |
| 2013/0195382 | A1 | 8/2013 | Murray | |

* cited by examiner

POUCH WITH SMOOTH SIDES

CROSS-REFERENCE TO RELATED APPLICATIONS

This application depends from and claims priority to U.S. Provisional Application No. 61/858,933 filed Jul. 26, 2013 and is a continuation in part application from U.S. patent application Ser. No. 14/444,081 filed on Jul. 28, 2014, which are both incorporated herein by reference.

FIELD OF THE INVENTION

The present invention relates generally to a container for packaging a product and more specifically to a flexible pouch having consumer friendly sides and a method of manufacturing the same.

BACKGROUND OF THE INVENTION

Various types of disposable portable containers are known in the art for storing a fluid or dry product such as a liquid, granular material, powder, or the like. Examples of containers include a cup, a metal can, a plastic bottle, a glass bottle, or a flexible pouch. Consumers prefer the convenience of flexible pouches over other types of containers due to their shape, size, shelf life, and storage adaptability. Manufacturers recognize the packaging benefits of a flexible pouch since the pouch can be formed and filled on the same manufacturing line. An example of a method and apparatus for filling a flexible pouch with a product is disclosed in commonly assigned U.S. Pat. No. 6,199,601 which is incorporated herein by reference.

The flexible pouch is made from a flexible material, preferably an extrusion or a laminate composed of sheets of plastic and aluminum or the like. An outer layer of material may include preprinted information such as a logo or the like to provide the customer with information regarding the contents of the pouch. The pouch may be formed and/or filled using conventionally known manufacturing techniques such as a horizontal form-fill-seal machine with single or multiple lanes, a flat bed premade pouch machine, a vertical form-fill-seal machine, or the like. The pouch includes a front panel and a back panel. The front and back panel can be sealed along the side edges. A gusset may be inserted along a bottom edge and sealed to the front and back panels, and a fitment may be inserted along the top edge or corner and sealed to the front and back panels. The pouch can be filled before the fitment is inserted or after the fitment is inserted by filling through the fitment.

The above described existing known manufacturing method produces a flexible pouch with sealed edges. However, the sealed edges formed by the known method can produce a side edge in the known pouch which may be uncomfortable for a consumer holding the pouch in his or her hand. As such, a flexible pouch design is desired which provides a more comfortable interface between the consumer and the pouch.

SUMMARY OF THE INVENTION

The present disclosure is directed to a container made from a flexible laminate material designed such that the edges of the container are smooth to the touch of a consumer. To put it another way, at least one of the edges of the container are formed by folding over a portion of container onto itself, thereby presenting a rounded surface for a consumer to interface with.

The container has a front panel and a back panel, each having an exterior surface. The front panel and the back panel are sealed to each other along a first side sealed portion. The first side sealed portion is secured to either the exterior surface of the front panel, or the exterior surface of the back panel. Securing the first side sealed portion to the exterior surface of the front or back panel forms a first smooth side with the portion of the container that is folded over, or flexed, to allow the first side sealed portion to be secured to the front or back panel.

One method to form the container discussed above begins with providing a flexible pouch with a front and back panel. The front and back panels are sealed to each other along a side sealed portion. A self adhesive material, such as glue or tape, is applied to an exterior surface of either the front or back panel in an area where it is anticipated the sealed side edge will abut the exterior surface when the container is folded along a predetermined fold line. The container is folded along the predetermined fold line, bringing the sealed side edge proximate to the applied adhesive. The sealed side edge is then pressed to abut the exterior surface in the area where the adhesive was applied, thereby securing the side sealed portion to the exterior surface of the front or back panel. It should be noted that the adhesive may be in strip form where the adhesive is applied in multiple strips.

A machine for practicing the above method to form the above discussed container includes a transport mechanism for the container. The transport mechanism has a direction of travel. A rail extends parallel to the direction of travel, and is located above the transport mechanism. The rail aligns with the container being transported such that the rail is directly above the predetermined fold line. A progressive plow with a start end and a finish end is positioned adjacent to the transport mechanism. The progressive plow extends parallel to the direction of travel of the transport mechanism. At the start end, the progressive plow has a generally flat top surface. A portion of the container transported by the transport mechanism travels along the top surface. The top surface transitions from being generally flat at the start end of the progressive plow, with the top surface changing in angle and curvature towards the finish end such that the portion of the pouch traveling along the top surface is folded over the rail. An adhesive dispensing mechanism is located above the transport mechanism, on a side of the rail opposite the progressive plow. A press mechanism is located above the transport mechanism at the finish end of the progressive plow. The press mechanism moves between a first position and a second position. When the press mechanism is in the first position clearance between the press mechanism and the transport mechanism allows the container to be aligned under the press. When the press is moved to the second position, the presses urges side sealed edges of the pouch to abut the front or back panel in the area where adhesive from the adhesive dispensing mechanism would be deposited.

BRIEF DESCRIPTION OF THE DRAWINGS

FIG. 23 is a front view of the alternative embodiment of the pouch with the sides folded in; and FIG. 24 is a perspective view of the alternative embodiment of the pouch with the sides folded in.

DETAILED DESCRIPTION OF THE PREFERRED EMBODIMENTS

Figure 1:
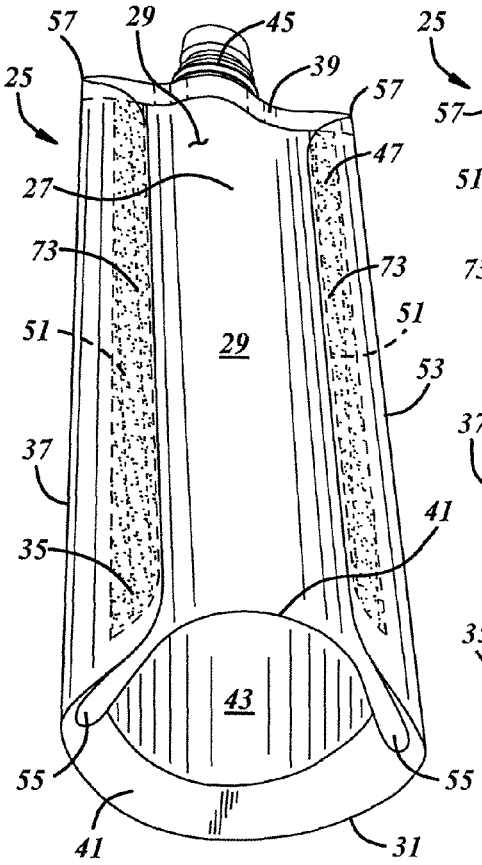
FIG. 1 is a perspective view of the front and bottom of a first embodiment of a pouch.

A flexible pouch that is more comfortable in a consumer's hand can be provided with the teaching of this disclosure, which includes a container assembly, a method for forming the container assembly, and a machine for manufacturing the container assembly.

With reference to FIGS. 1-8, a container assembly 25 of the present disclosure includes a front panel 27 having an exterior surface 29 and a back panel 31 having an exterior surface 33. The front panel 27 is sealed to the back panel 31 along at least a portion of a perimeter of the container assembly 25, including a first side sealed portion 35. The first side sealed portion 35 is secured to the exterior surface 29 of the front panel 27. Securing the first side sealed portion 35 to the panel exterior surface 29 provides a curved shape to the container assembly 25 through the formation of a first smooth side 37 on the container assembly 25. It is appreciated that the first side sealed portion 35 could alternately be secured to the exterior surface 33 of the back panel 31 to form the smooth side 37.

The container assembly 25 further includes a top portion 39, and a bottom portion 41. A gusset 43 is disposed between the front panel 27 and the back panel 31 at the bottom portion 41 of the container assembly, and a fitment 45 is disposed between the front panel 27 and the back panel 31 at the top portion 39 of the container assembly 25.

Figure 2:
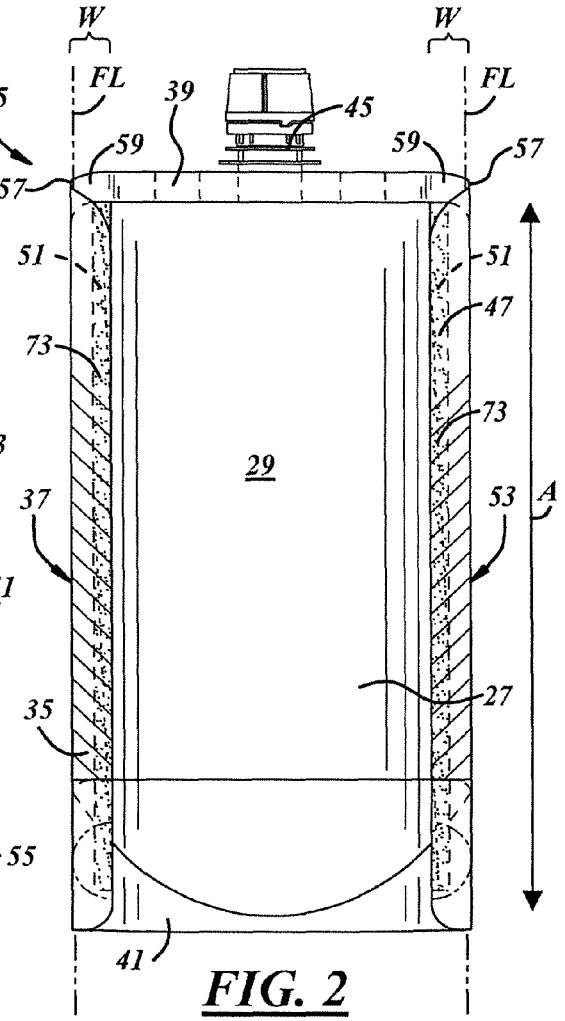
FIG. 2 is an elevational front view of the first embodiment of the pouch.
Figure 3:
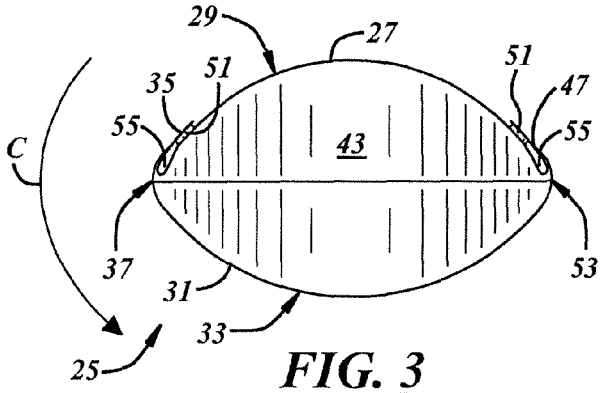
FIG. 3 is a plan bottom view of the first embodiment of the pouch.

As shown in FIGS. 1-3, the front panel 27 is sealed to the back panel 31 along the first side sealed portion 35, and a second side sealed portion 47. The front panel 27 and back panel 31 are sealed to each other, and to the fitment 45 at the top portion 39. The front panel 27 and back panel 31 are sealed to the gusset 43 at the bottom portion 41. The perimeter of the container assembly 25 is generally rectangular in shape when viewed from the front. Sealing is accomplished by applying heat and pressure to the area to be sealed, ultrasonic welding, or any other method(s) known to those skilled in the art. In the above discussed embodiment, the front panel 27 and back panel 31 are separate sheets of flexible material overlaid onto each other and sealed together to form the container assembly 25. It is appreciated that, as an alternative, the front panel and back panel can be formed by a single sheet of flexible material which is folded over (not shown), thereby eliminating the need for the second side sealed portion 47.

The container assembly 25 is formed by folding the first side sealed portion 35 on a flexible pouch 49 over a predetermined fold line FL. Before the container 25 is formed, the fold line FL extends from the top portion 39 to the bottom portion 41, and is located inward of the side sealed portion 35 towards where the fitment 45 would be located, or center or the pouch 49, as can be seen in FIGS. 16-19. The side sealed portion 35 is attached to the front panel 27 far enough toward the center such that the side sealed portion 35 is not included in the first smooth side 37, thereby reducing stress on the sealed portion 35. The sealed portion 35 is secured with adhesive 51. Non-limiting examples of adhesives 51 include spray-on or brush-on glue, double sided tape, single sided tape, ultrasonic welding, application of heat and pressure, or any other method(s) known to those skilled in the art. The second side sealed portion 47 is folded over another predetermined FL on the opposite side of the pouch 49 and secured to the front panel 27 similar to the first side sealed portion 35, to form a second smooth side 53.

Figure 6:
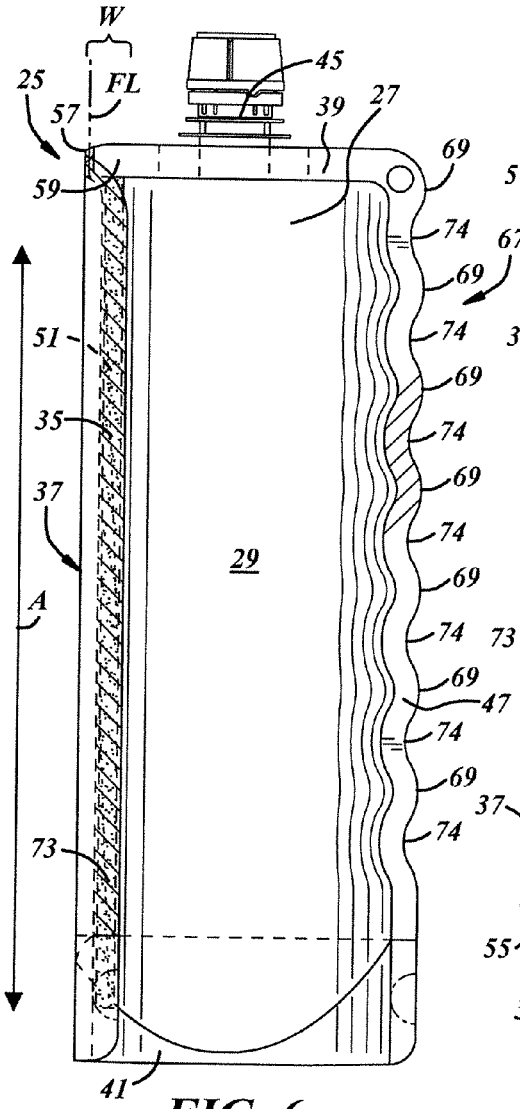
FIG. 6 is an elevational back view of a second embodiment of the pouch.
Figure 8:
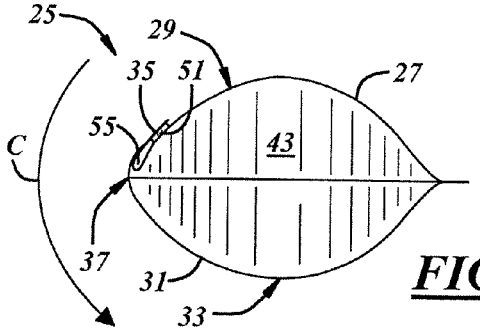
FIG. 8 is a plan bottom view of the second embodiment of the pouch.

The smooth sides 37, 53 extend in an axial direction A from the top portion 39 to the bottom portion 41 of the container assembly 25. The smooth sides 37, 53 are generally linear along the axial direction A, as shown in FIGS. 2 and 6. To put it another way, the smooth sides 37, 53 are generally flat in profile as they extend in a direction from the top portion 39 to the bottom portion 41. The smooth sides 37, 53 have a curved profile, without sharp corners or cusps, in a circumferential direction C around the container assembly 25, as shown in FIGS. 3 and 8. To put it another way, the smooth sides 37, 53 form an exterior curved shape along a plane normal to an axial direction A of the container assembly 25. When the side sealed portion(s) 35, 47 is folded of and secured to the panel 27, care is taken no to press or crease in the area of the smooth side(s) 37, 53 to help insure the integrity of the laminate material, thereby ensuring product quality of any items storage in the container 25.

The container assembly 25 also includes a passage 55. The passage 55 extends from the top portion 39 to the bottom portion 41, and is defined by the area enclosed by the flexible material folded at the fold line FL to secure the first side sealed portion 35, or second side sealed portion 53, to the front panel 27 or the back panel 31. The curved flexible material defining the passage 55 gives the container assembly 25 more rigidity than the flexible pouch 49 would otherwise have, enabling a more upright and free standing container with a taller, skinnier design.

Rounded corners 57 are located on the container assembly 25 in an area where the top portion 39 meets the sealed side portions 35, 47. The curvature of the rounded corners 57 begins on a fitment side 59 of the predetermined fold line FL, such that the rounded corners 57 are not eliminated by securing the sealed side portions 35, 47 to the front panel 27 or the back panel 31. Including the rounded corners 57 reduces the creation of a sharp corner where the smooth sides 37, 53 meet the top portion 39.

Figure 4:
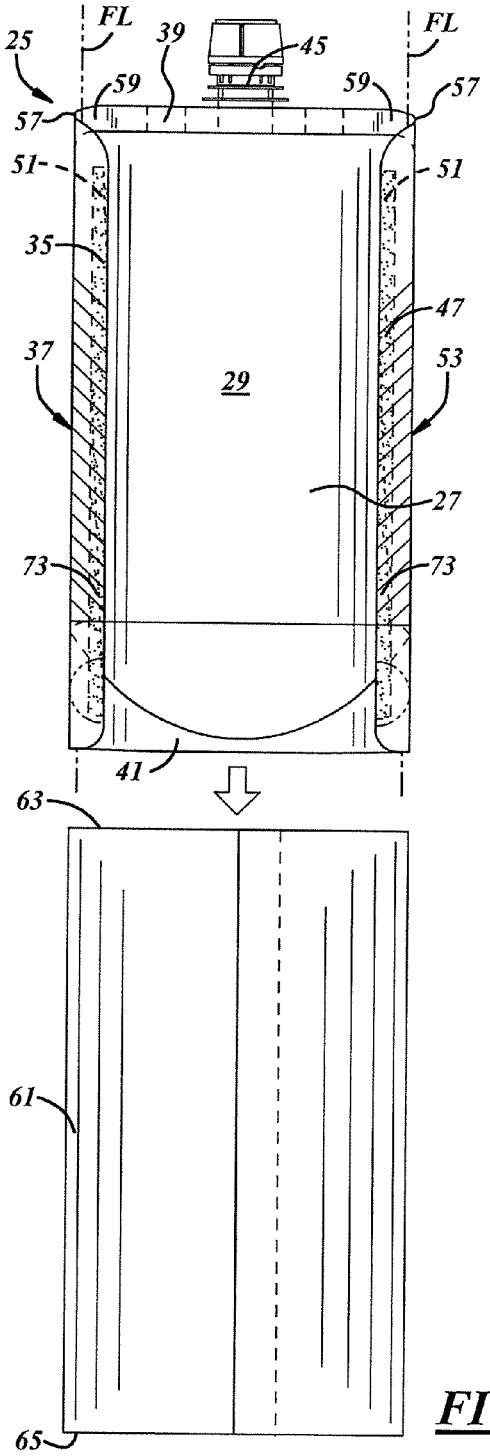
FIG. 4 is an elevation view of the first embodiment of the pouch being inserted into a sleeve.
Figure 5:
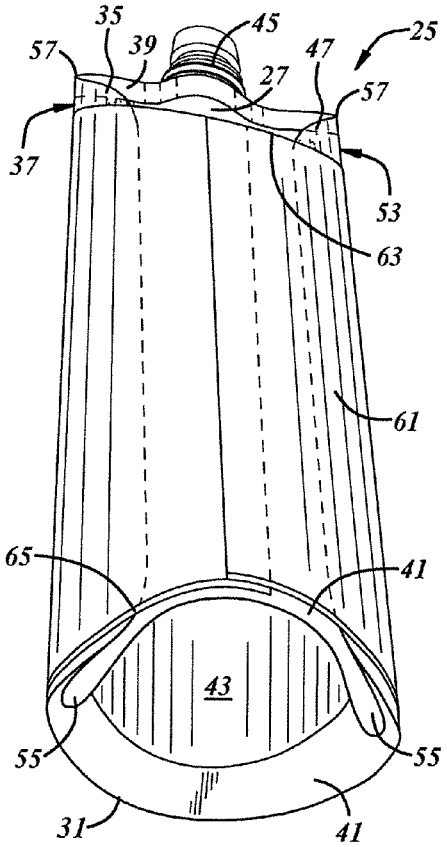
FIG. 5 is a perspective view of the front and bottom of the first embodiment of the pouch disposed within the sleeve.

To provide further comfort in a consumer's hand, the container assembly 25 as described above is partially disposed within a sleeve 61, which is found in FIGS. 4 and 5. The sleeve 61 is made from a strip paper, or other suitable material, secured to itself to form a closed loop having at least one open end 63. The sleeve 61 is snuggly disposed around the container assembly 25, with the top portion 39 extending from the at least one open end 63. The sleeve 61 features a second open end 65 opposite the first open end 63, providing easy manufacturing and assembly of the container assembly 25 within the sleeve 61. The sleeve 61 can be formed first, and the container assembly 25 inserted into the sleeve 61, or the sleeve 61 can be formed around the container assembly 25. The sleeve 61 can be secured to the container assembly 25 using adhesive, such as tape or glue, or by any other means known to those skilled in the art. It is appreciated that while the preferred material for the sleeve 61 is paper, any other thin flexible material can be used. The sleeve 61 helps to provide a comfortable consumer interface by further smoothing the exterior of the container assembly 25, increasing the rigidity of the container assembly, and providing a more oval shape without corners or cusps when viewed from the top or bottom of the container assembly 25.

Figure 7:
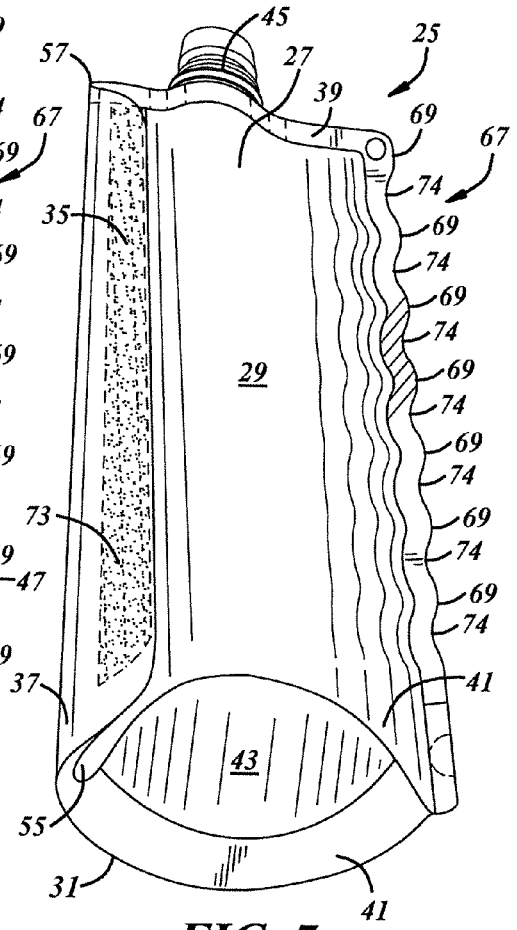
FIG. 7 is a perspective view of the front and bottom of the second embodiment of the pouch.

Another embodiment of the container assembly 25, as shown in FIGS. 6-8 is similar to that described previously, in that the container assembly 25 includes the front panel 27 and back panel 31, with the first smooth side 37 being formed by the first side sealed portion 35 being secured to the front panel 27 or back panel 31. However, the second side sealed portion 47 is not secured to one of the panels 27, 31, and instead the second side sealed portion 47 includes a waved profile 67 with alternating peaks 69 and valleys 71.

The second side sealed portion 47 including the waved profile 67 is located on the container assembly 25 opposite the first smooth side 37, and extends generally from the top portion 39 to the bottom portion 41. The waved profile 67 provides further consumer comfort, as the consumer can place their fingers in the valleys 71 while holding the container assembly 25. The consumer's comfort is further enhanced by the waved profile 67 having a continuous shape; specifically it does not include any sharp corners or other cusps in the areas where a consumer would naturally place their fingers when viewed from the front of the container assembly 25.

Figure 9:
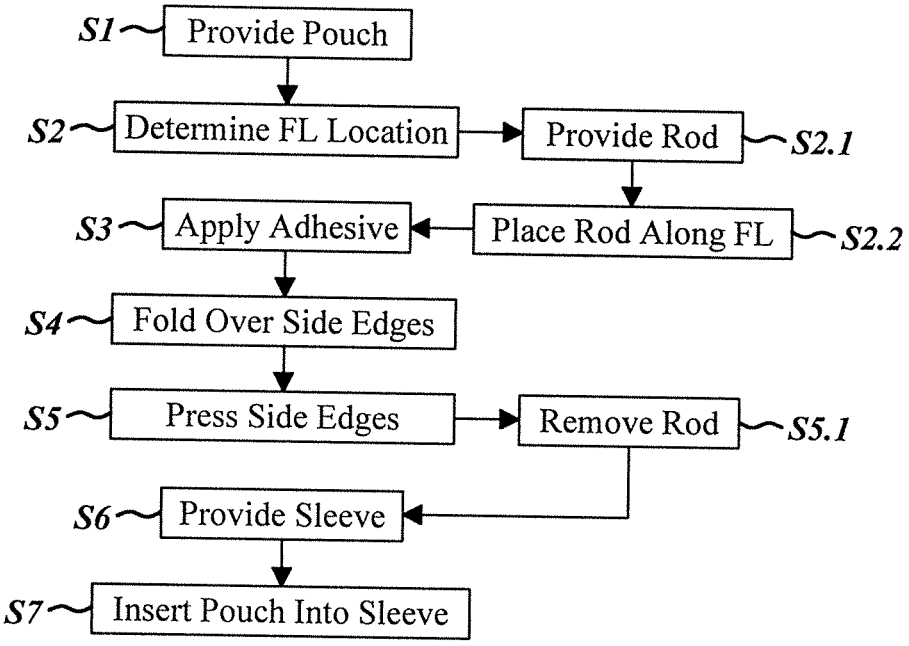
FIG. 9 is a flow chart for a method using to manufacture the pouch.

One method, as shown in FIG. 9, to produce the container assembly 25 of the present disclosure involves: providing the flexible pouch 49 at step S1; determining the location of the fold line(s) FL at step S2; applying the adhesive 51 to an area 73 of the flexible pouch 49 at step S3; folding the flexible pouch 49 along the fold line(s) FL at step S4; and pressing the side sealed portion(s) 35, 47 onto the area 73 where the adhesive 51 was applied at step S5. Further steps of providing the sleeve 61 with at least one open end 63 at step S6, and inserting the pouch 49 into the sleeve 61 at step S7, may then be performed.

The flexible pouch 49 provided in at step S1 includes the front panel 27 and back panel 31 formed from single or multiple sheets of flexible material, as discussed above. The flexible pouch 49 is sealed around its perimeter, for example along the sides 35, 47, top 39 and bottom 41 portions, and can include the gusset 43 and/or fitment 45. The sealed perimeter includes at least one side sealed portion 35.

To determine where the one or more fold lines FL should be located at step S2, the width W of the side sealed portion(s) 35, 47, and the desired profile of the smooth sides(s) 37, 53 to be formed are taken into account. The fold lines FL should be located far enough from the sealed portion(s) 35, 47 and toward the center of the flexible pouch 49, such that the sealed portion(s) 35, 47 is not folded or subjected to an excessive amount of stress by being located within the area of the smooth side(s) 37, 53 after the folding ever step has be performed.

Adhesive 51 is applied in the area 73 on the front panel 27 or back panel 31 that is expected to abut the side sealed portion(s) 35, 47 once they have be folded. This area 73 is typically parallel to, and located offset on the more central side of the fold line FL. The adhesive 51 could be applied in a flowable form by nozzle 75 and/or brush application. Additionally, the adhesive 51 could be applied in an aerated form, such as being sprayed on with compressed gas or air, or the adhesive 51 could be applied attached to a secondary medium, such as double sided tape. When applying adhesive 51, care should be taken to apply only so much adhesive 51 as is needed. Excess adhesive 51, and/or adhesive 51 in the wrong spot could interfere with a consumer, for example by sticking to the consumer's hand.

To assist in folding over the flexible pouch 49, a rod/rail 57 can be provided at step S2.1 and placed along each predetermined fold line(s) FL at step S2.2, thereby helping to produce the smooth side(s) 37, 53 while locating the fold in the right location.

Pressing the side sealed portion(s) 35, 47 against the panel 27, 31 of the flexible pouch 49 in the area 73 where adhesive 51 was applied should be done in a matter that urges the adhesive 51 away from the center of the container assembly 25, thereby causing excess adhesive to flow in the passage 55, where the adhesive 51 will remain free from interference with the consumer. After pressing, the rod/rail 77, if used, is removed at step S5.1. The rod/rail 77 having been disposed within the passage during pressing but removed thereafter.

Applying adhesive 51 to the flexible pouch 49, and folding the flexible pouch 49 about the fold line FL, pressing of the side sealed portion(s) 35, 47 to abut the front panel 27 or back panel 31 can be done by hand, or by machine, as further described below.

Figure 10:
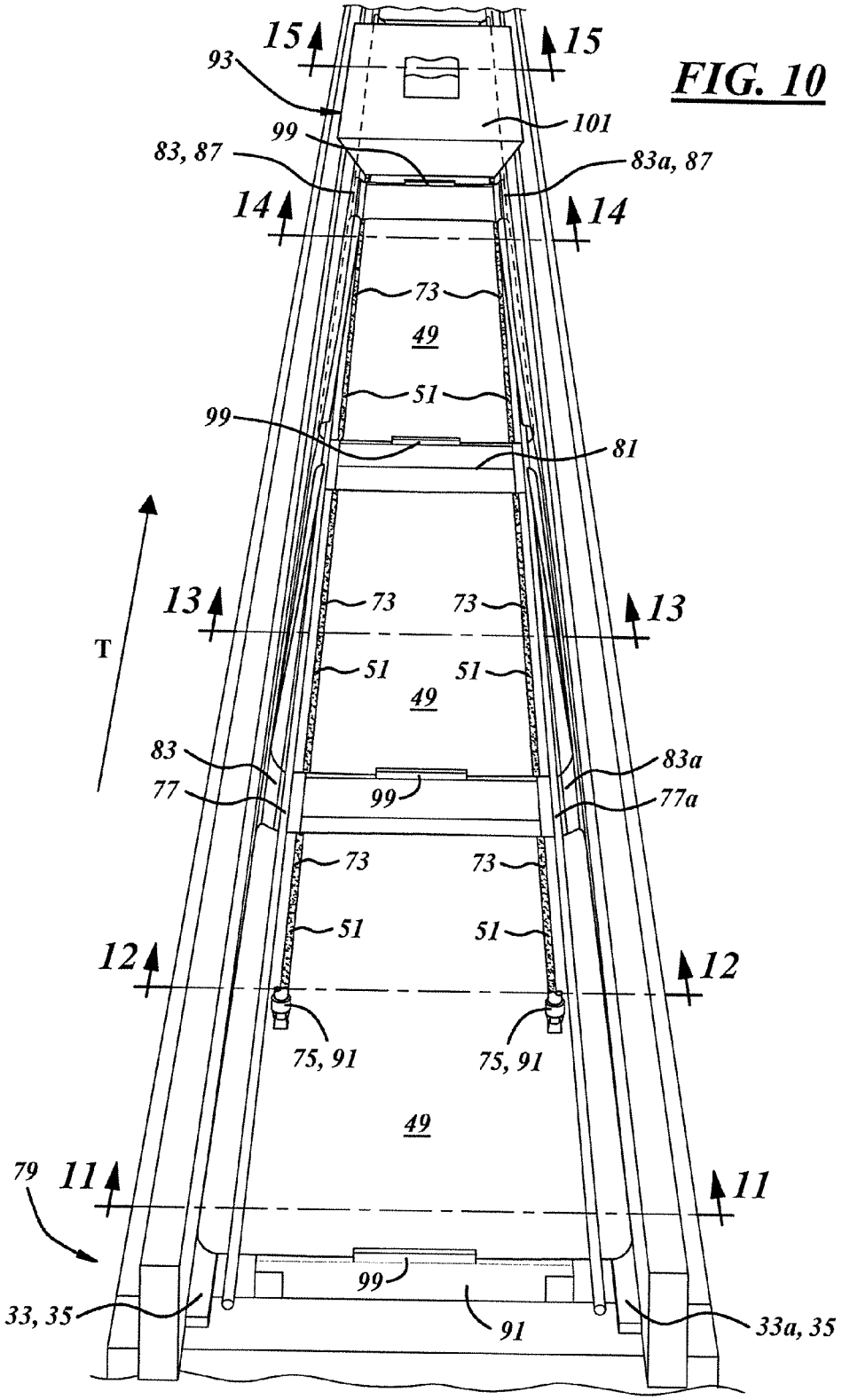
FIG. 10 is a perspective view of a machine for producing the first embodiment of the pouch.
Figure 11:
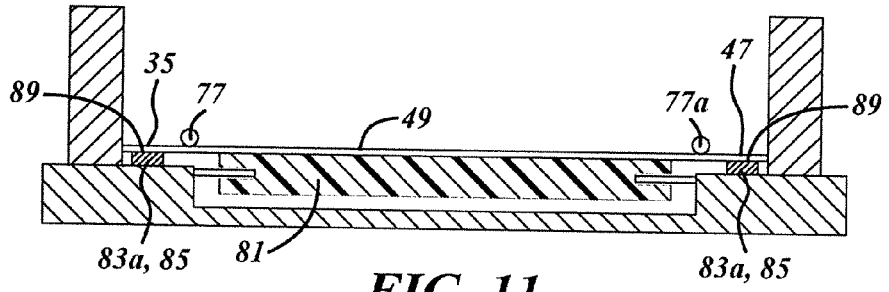
FIG. 11 is a cross sectional view of the machine as the pouch is progressed and formed.
Figure 12:
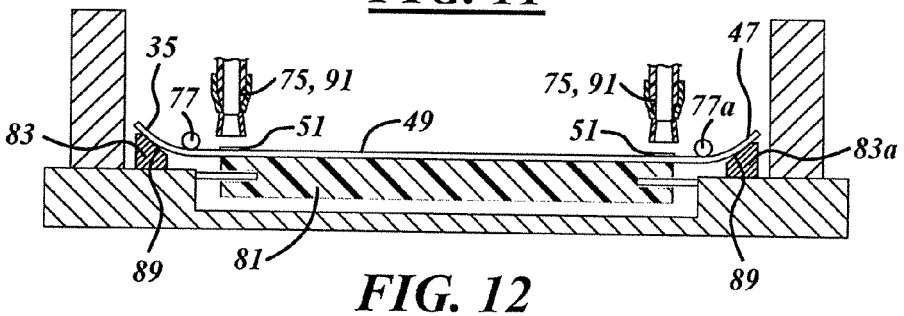
FIG. 12 a cross sectional view of the machine as the pouch is progressed and formed.
Figure 13:
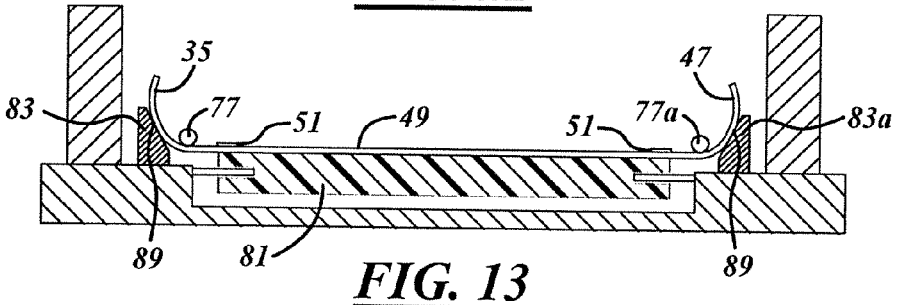
FIG. 13 a cross sectional view of the machine as the pouch is progressed and formed.
Figure 14:
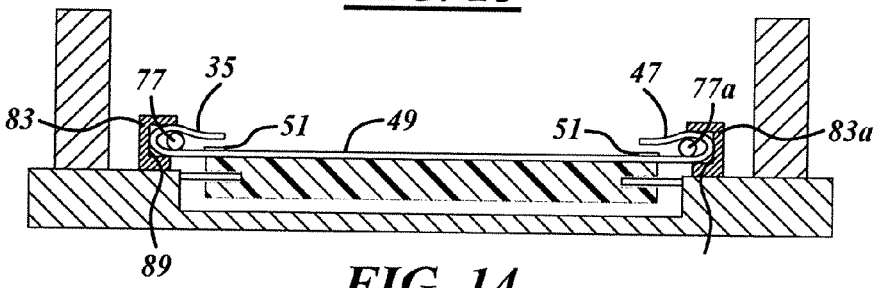
FIG. 14 a cross sectional view of the machine as the pouch is progressed and formed.

With reference now to FIGS. 10-15 and 20-21, one type of machine for producing the container assembly 25 described above includes a transport mechanism 79, such as a conveyor belt 81, can be seen in FIG. 10. The transport mechanism 79 moves in a direction of travel, represented by the arrow T, so as to move the flexible pouch 49 through the machine to form the container assembly 25. A rail 77 is disposed above the transport mechanism 79. The rail 77 runs parallel to the direction of travel T of the transport mechanism 79. The rail 77 is positioned above the transport mechanism 79 in a location that aligns with the location of the desired fold line FL on the pouch 49 being transported by the transport mechanism 79.

A progressive side plow 83 is located adjacent the pouch transport mechanism 79. The progressive side plow 83 runs generally parallel to the direction of travel T of the transport mechanism 79 from a start end 85 of the progressive side plow 83 to a finish end 87 of the progressive side plow 83. The start end 85 has a top surface 89 that begins general flat and changes in angle and curvature along the length of the side plow 83, all the way to the finish end 87 where the surface 89 is C-shaped. The progressive change in shape of the surface 89 from generally flat to C-shaped causes the pouch 49 to be folded over the rail 77.

An adhesive application mechanism 91 is located above the transport pouch transport mechanism 79 on a side of the rail 77 opposite the progressive plow 83. The adhesive application mechanism 91 is aligned such that the adhesive 51 is applied by the mechanism 91 onto the proper area 53 of the pouch 49 as discussed above.

A press mechanism 93 is located above the transport mechanism 79 at the finish end 87 of the progressive side plow 83. The press mechanism 93 is operable to move between a first position 95 and a second position 97, as shown by arrow M. The first position 95 of the press mechanism 93 allows the pouch to be aligned under the press mechanism 93. The second position 97 of the press mechanism 93 urges the side sealed portion 35 of the pouch 49 to abut the front panel 27 or back panel 31 of the pouch 47 in an area where adhesive 51 was applied by the adhesive application mechanism 91.

One example of the pouch transport mechanism 79 includes the conveyor 81, which is a flat belt type that is typically caused to move by way of powered rollers. The conveyor 81 can be a flexible material, such a rubber or synthetic, it can be a series of interlocked links like those of a tank tread made from plastic or metal, or any other similar type device known to those skilled in the art. One or more of stops 99 extend from the conveyor 81 to aid in movement of the pouch 49 through the machine. The pouch 49 rides on the conveyor 81 and is moved through the machine by way of being held in place by gravity, and by being pushed in the direction of travel T by the stop 99 abutting the pouch 49. Other transport mechanisms, in addition to the conveyor 81 with stops 99, are capable of producing the machine for making the container assembly 25. For example, the transport mechanism could use grippers or suction (not shown) to move a pouch in a vertical, horizontal, or other direction, along the progressive side plow 83 and rail 77.

The rail 77 is generally circular in cross section, as can be seen in FIGS. 11-15. The rail 77 can be made of metal rod stock, rigid tubing, or any other material known to those skilled in the art, provided the rail 77 had a smooth outer surface that would not cause the pouch to hang up or bind in the machine as the pouch was folded over the rail 77 by the plow 83.

The adhesive application mechanism 91 applies the adhesive 51 to the pouch 49. The adhesive application mechanism 91 may utilize the nozzle 75 to flow the liquid or aerated adhesive onto the pouch, with the nozzle 75 directing the adhesive to the desired area 73 on the flexible pouch 49. Alternatively, a brush type application could replace the nozzle with the adhesive 51 supplied to bristles of the brush (not shown), or a roll on type application with a cutter (not shown) could be used to apply double sided taped type adhesive 51, or any other adhesive 51 and applicator known to those skilled in the art that are suitable for the application of adhesive 51 in the proper location 73 on the pouch 49.

The progressive side plow 83 folds the pouch over the rail 77 by way of the surface 89 having a generally flat shape at the start end 85 transitioning into a general C-shape at the finish end 87, as shown in FIGS. 11-15. As the pouch 49 is moved though the machine by the transport mechanism 79, the side sealed portion 35 abuts the top surface 89 of the side plow 83. At the start end 85 both the pouch 49 and the surface 89 of the side plow 95 are generally flat. The pouch 49 conforms to the surface 89 as it changes in shape towards the finish end 94. Specifically, as the surface 89 begins to increase in angle, it urges the side sealed portion 35 upward. At the same time, movement of the pouch 49 is restricted by the rail 77. A combination of the forces applied by surface 92 and the rail 77 cause the pouch 49 to bend about the rail 77. As the surface 92 continues to change shape as progression is made towards the finish end 87, the pouch 49 is folded further over the rail 77, until the side sealed portion 35 overlaps the adhesive 51 applied by the adhesive application mechanism 91.

Figure 20:
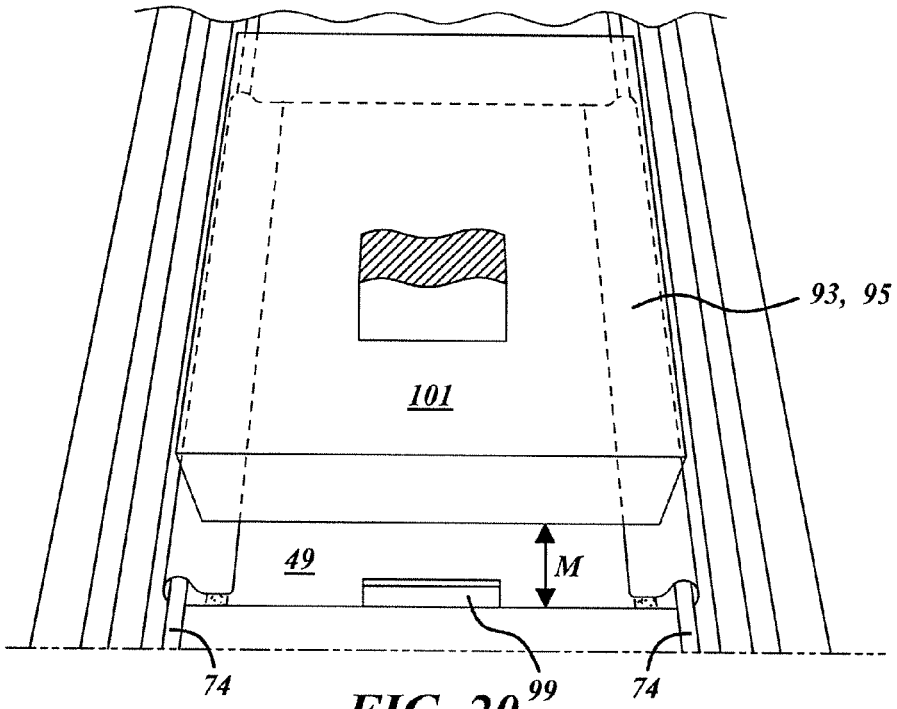
FIG. 20 is a perspective view of a press mechanism of the machine shown in FIG. 10 in an up position.
Figure 21:
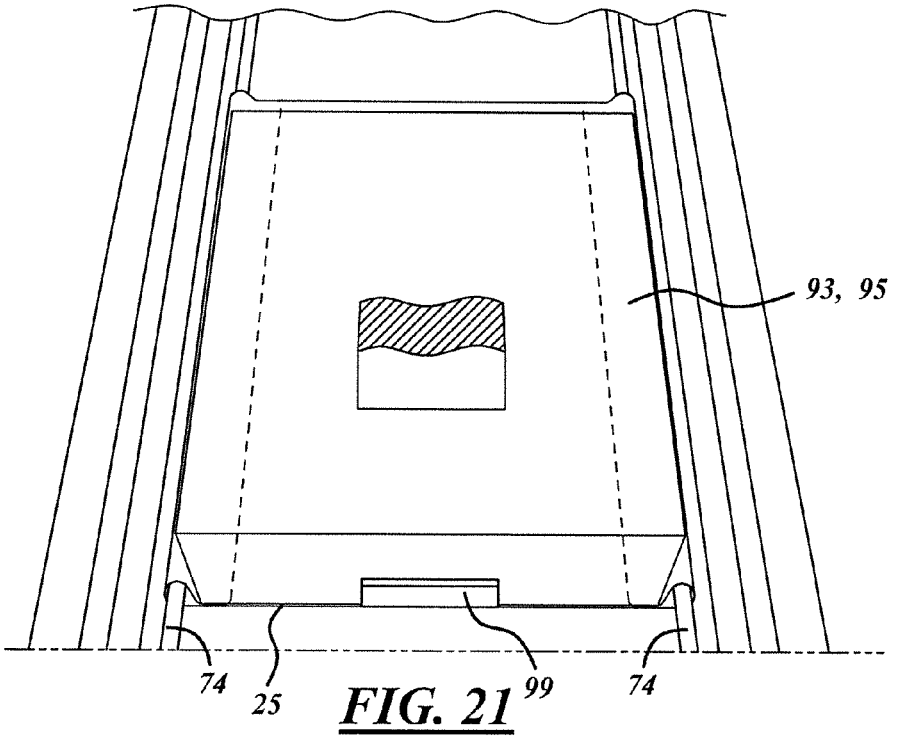
FIG. 21 is a perspective view of the press mechanism shown in FIG. 20 in a down position.

With reference now to FIGS. 20 and 21, the press mechanism 93 moves between the first position 95 and second position 97 to urge the overlapping side sealed portion 35 to about the front or back panel 27, 31 of the pouch 49 where the adhesive 51 was applied by the adhesive application mechanism 91. The first position 95, or 'up' position, provides clearance between the press mechanism 93 and the transport mechanism 79 such that the pouch 49 can be positioned under the press mechanism 93. The second position 97, or 'down' position, causes a pressing member 101 of the press mechanism 93 to urge the side sealed portion 35 onto the applied adhesive so that the side sealed portion 35 securely abuts the front or back panel. Movement of the press mechanism 93 between the first position 95 and the second position 97 can be achieved with a hydraulic cylinder, a rack and pinion type setup, or any other method or combination of mechanisms and methods known to those skilled in the art.

The press mechanism 93 includes the pressing member 101 which has a tapered portion 103. The tapered portion 103 is tapered in such a manner that a first end of the taper 105 is closer to the transport mechanism 79 than a second end of the taper 107. The first end of the taper 105 is located to the inside of the second end of the taper 107 such that the first end of the taper 105 contacts the pouch 49 before the second end of the taper 107 thereby causing the sealed side portion 35 to be urged in a progressive manner with force applied more centrally on the pouch 49 first, then moving outward. The tapered portion 103 thereby causes any excess adhesive 51 under the tapered portion 105 to be urged outward toward the passage 55 where it will remain hidden from view of a consumer.

Figure 15:
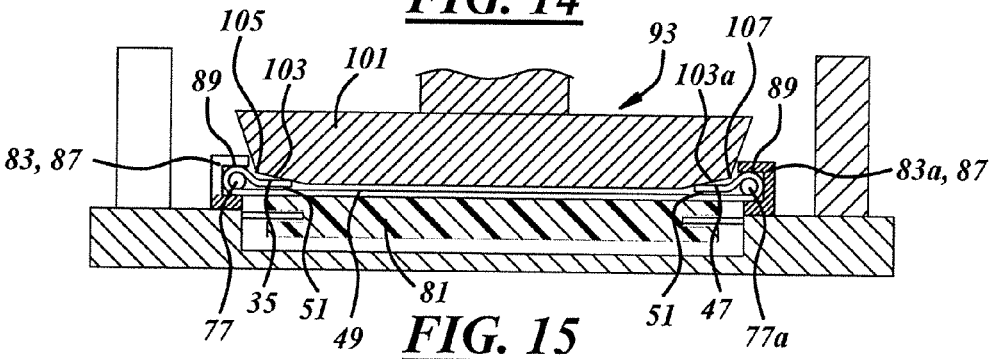
FIG. 15 a cross sectional view of the machine as the pouch is progressed and formed.
Figure 16:
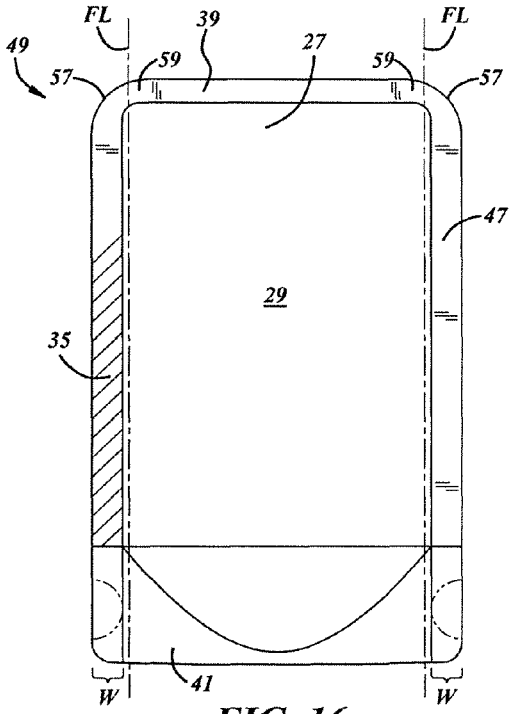
FIG. 16 is an elevational front view of a pouch having features used to form the first embodiment container.
Figure 17:
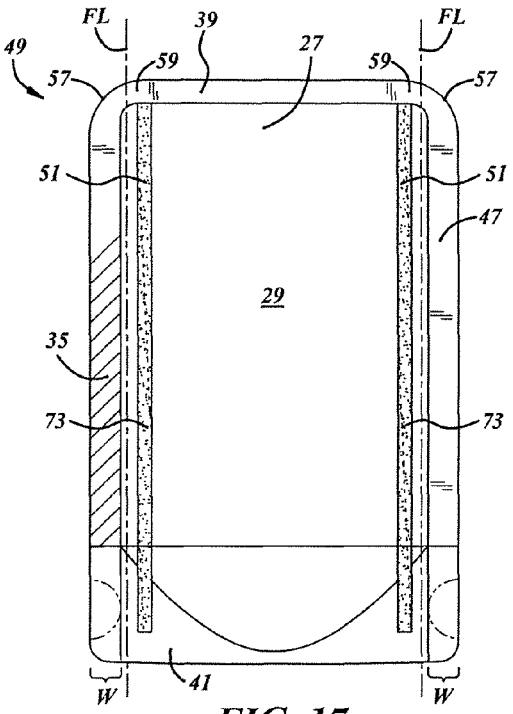
FIG. 17 is an elevational front view of the pouch having features to form the first embodiment container with adhesive.
Figure 18:
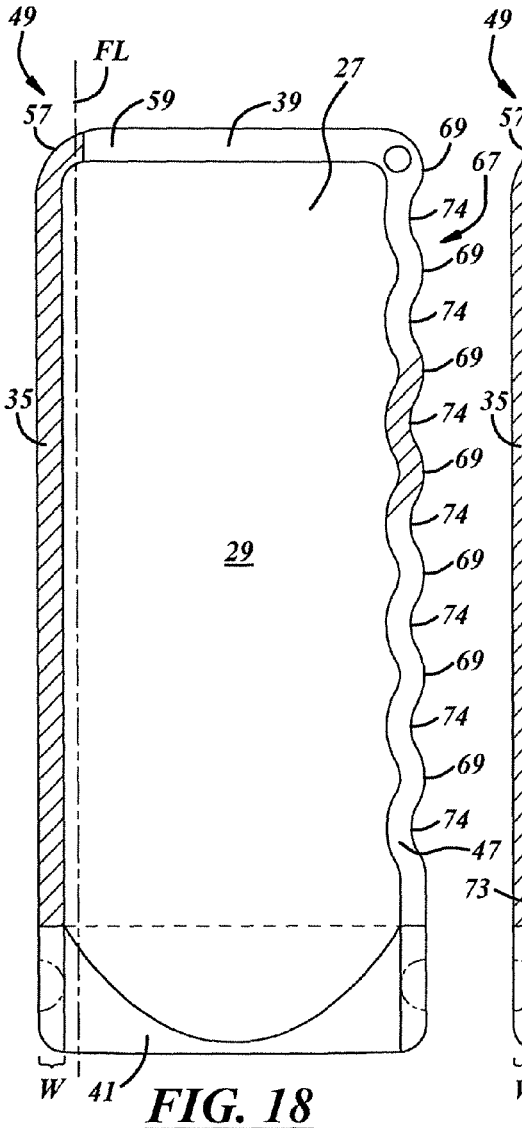
FIG. 18 is an elevational front view of a pouch having features used to form the second embodiment container.
Figure 19:
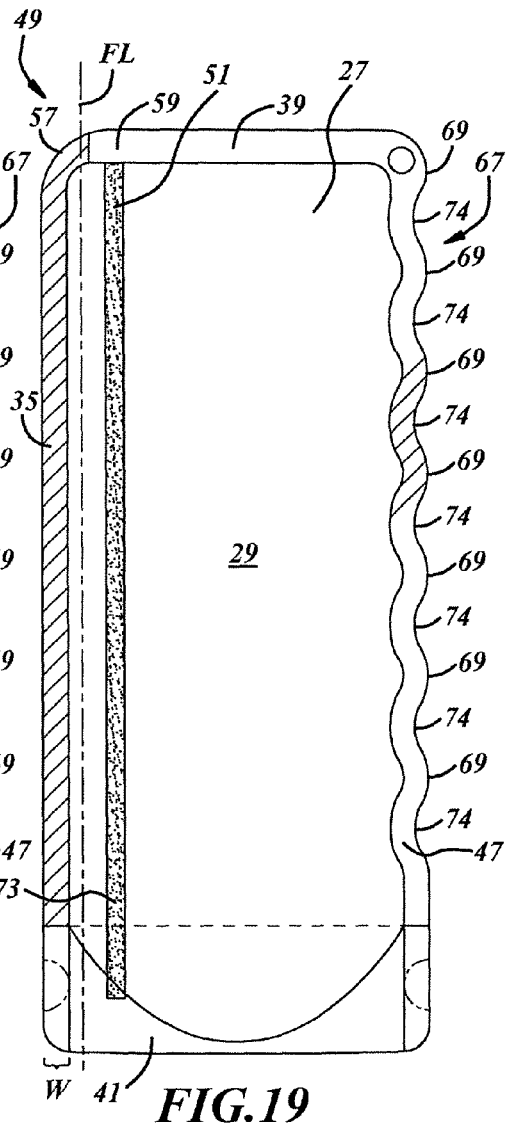
FIG. 19 is an elevational front view of a pouch having features used to form the second embodiment container with adhesive.

To form the second smooth side 53 on the container assembly 25, another progressive side plow 83*a* and another rail 77*a* are included in the machine. The side plow 83*a* and rail 77*a* are located on the opposite side of the pouch transport mechanism 79, and have similar characteristics to the side plow 83 and rail 77 described above to fold over and secure the second side sealed 42. The same transport mechanism 79 and press mechanism 93 can be used with the progressive side plows 83, 83*a* and rails 77, 77*a* straddling opposite sides of the transport mechanism 79, thereby folding over the side sealed portions 35, 47 at the same time. With this arrangement, and the addition of another tapered portion 103*a*, the press mechanism 93 can be used to urge both side sealed portions 35, 47 to about the front panel 27 or back panel 31, as shown in FIG. 15.

Figure 22:
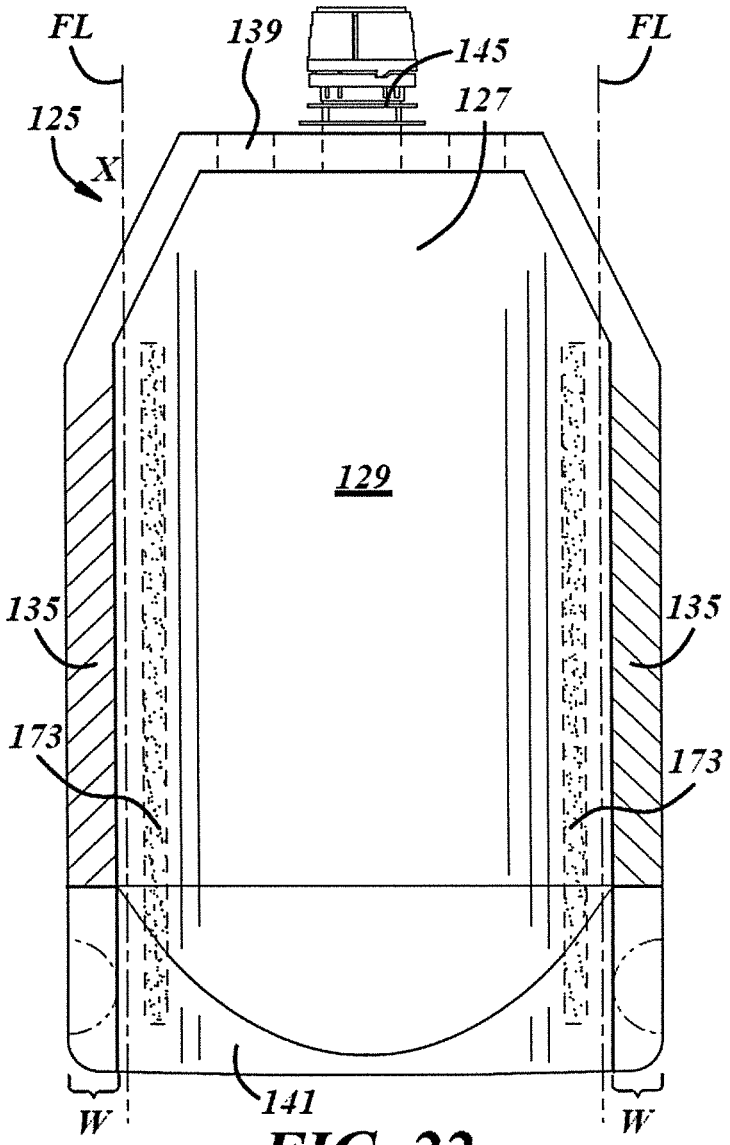
FIG. 22 is a front view of the an alternative embodiment of the pouch.
Figure 23:
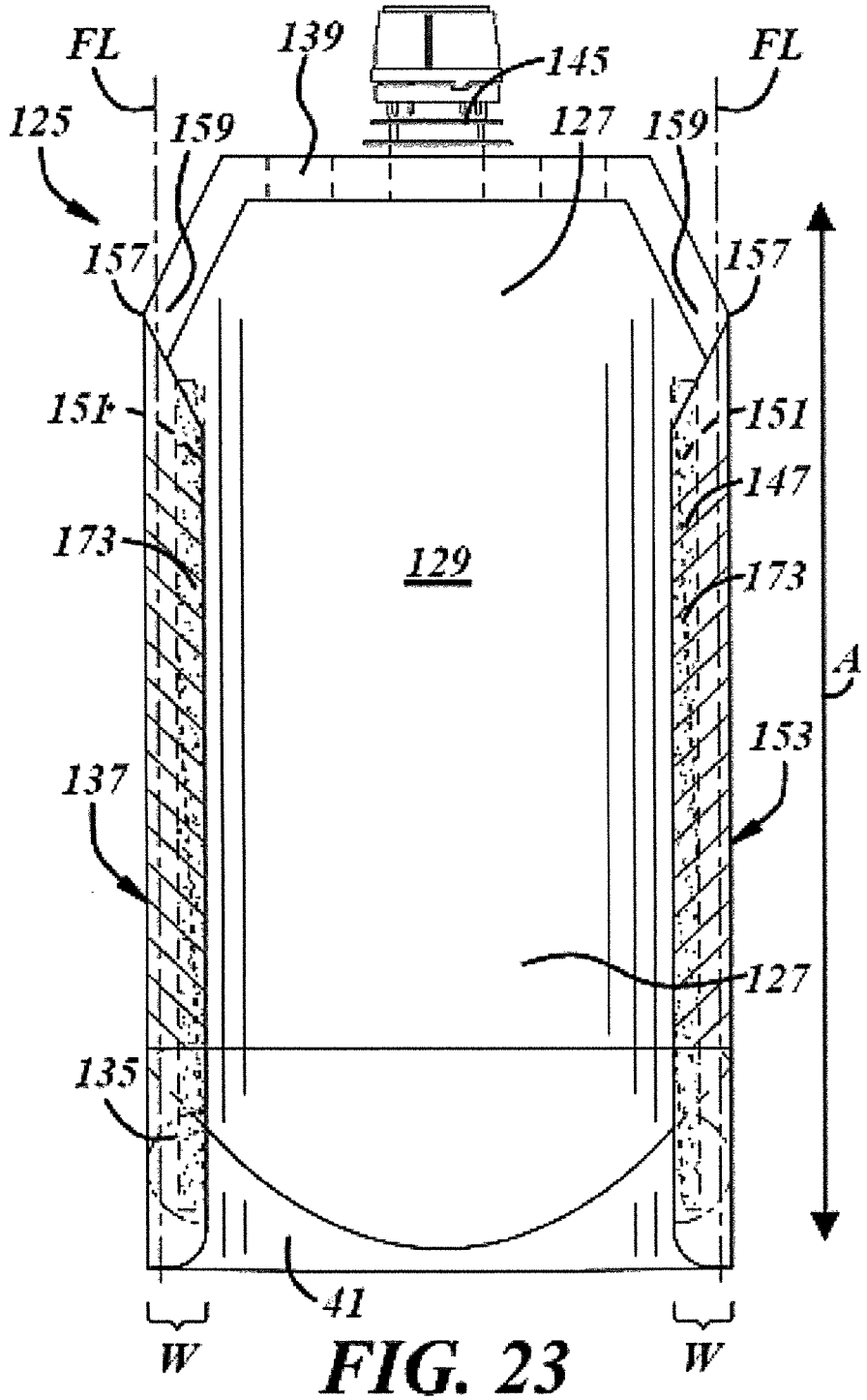
Figure 24:
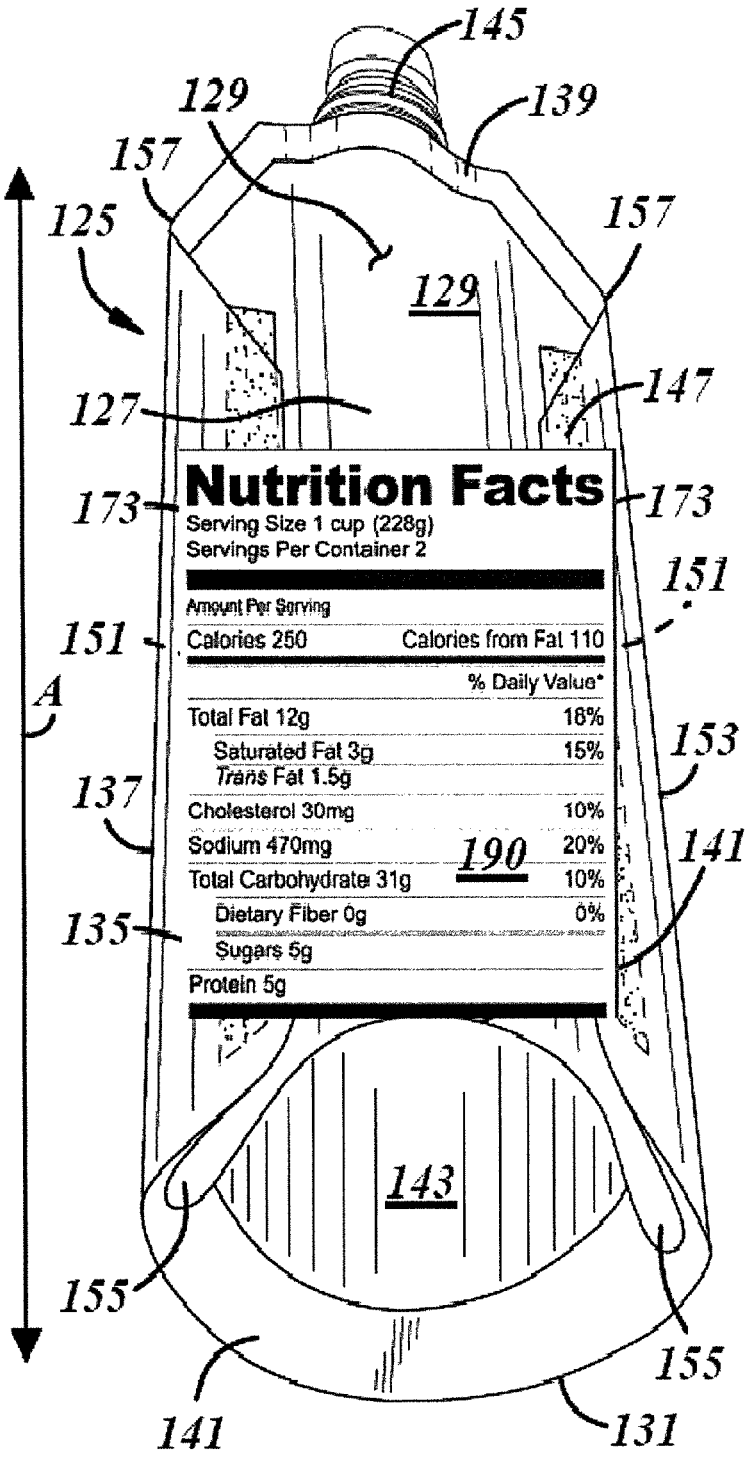

With reference to FIGS. 22-24, a container assembly 125 of the present disclosure includes at least one angled portion 157. The angled portion 157 provides for a more seamless appearance to the pouch. The angled portions 157 further allow a sleeve to more seamlessly be placed over the container assembly 125. The angled portions 157 extend between a first sealed portion 135 and a top portion 139.

The container assembly 125 includes a front panel 127 having an exterior surface 129 and a back panel 131 having an exterior surface. The front panel 127 is sealed to the back panel 131 along at least a portion of a perimeter of the container assembly 125, including a first side sealed portion 135. The first side sealed portion 135 is secured to the exterior surface 129 of the front panel 127. Securing the first side sealed portion 135 to the panel exterior surface 129 provides a curved shape to the container assembly 125 through the formation of a first smooth side 137 on the container assembly 125. In some embodiments, a sticker or label 190 (having an adhesive) is placed on the exterior surface 129 to act as an adhesive to hold the sides down, as shown. It is appreciated that the first side sealed portion 135 could alternately be secured to the exterior surface of the back panel 131 to form the smooth side 137.

The container assembly 125 further includes a top portion 139, and a bottom portion 141. A gusset 143 is disposed between the front panel 127 and the back panel 131 at the bottom portion 141 of the container assembly, and a fitment 145 is disposed between the front panel 127 and the back panel 131 at the top portion 139 of the container assembly 125.

As shown in FIGS. 22-24, the front panel 127 is sealed to the back panel 131 along the first side sealed portion 135, and a second side sealed portion 147. The front panel 127 and back panel 131 are sealed to each other, and to the fitment 145 at the top portion 139. The front panel 127 and back panel 131 are sealed to the gusset 143 at the bottom portion 141. The perimeter of the container assembly 125 is generally rectangular in shape when viewed from the front. Sealing is accomplished by applying heat and pressure to the area to be sealed, ultrasonic welding, or any other method(s) known to those skilled in the art. In the above discussed embodiment, the front panel 127 and back panel 131 are separate sheets of flexible material overlaid onto each other and sealed together to form the container assembly 125. It is appreciated that, as an alternative, the front panel and back panel can be formed by a single sheet of flexible material which is folded over (not shown), thereby eliminating the need for the second side sealed portion 147.

The container assembly 125 is formed by folding the first side sealed portion 135 on a flexible pouch over a predetermined fold line FL. Before the container 125 is formed, the fold line FL extends from the top portion 139 to the bottom portion 141, and is located inward of the side sealed portion 135 towards where the fitment 145 would be located, or center or the pouch, as can be seen in FIGS. 16-19. The side sealed portion 135 is attached to the front panel 127 far enough toward the center such that the side sealed portion 135 is not included in the first smooth side 137, thereby reducing stress on the sealed portion 135. The sealed portion 135 is secured with adhesive 151. Non-limiting examples of adhesives 151 include spray-on or brush-on glue, double sided tape, single sided tape, ultrasonic welding, application of heat and pressure, or any other method(s) known to those skilled in the art. The second side sealed portion 147 is folded over another predetermined FL on the opposite side of the pouch and secured to the front panel 127 similar to the first side sealed portion 135, to form a second smooth side 153.

The smooth sides 137, 153 extend in an axial direction A from the top portion 139 to the bottom portion 141 of the container assembly 125. The smooth sides 137, 153 are generally linear along the axial direction A, as shown in FIGS. 23 and 24. To put it another way, the smooth sides 137, 153 are generally flat in profile as they extend in a direction from the top portion 139 to the bottom portion 141. The smooth sides 137, 153 have a curved profile, without sharp corners or cusps, in a circumferential direction C around the container assembly 125. To put it another way, the smooth sides 137, 153 form an exterior curved shape along a plane normal to an axial direction A of the container assembly 125. When the side sealed portion(s) 135, 147 is folded of and secured to the panel 127, care is taken no to press or crease in the area of the smooth side(s) 137, 153 to help insure the integrity of the laminate material, thereby ensuring product quality of any items storage in the container 125.

The container assembly 125 also includes a passage 55. The passage 55 extends from the top portion 139 to the bottom portion 141, and is defined by the area enclosed by the flexible material folded at the fold line FL to secure the first side sealed portion 135, or second side sealed portion 153, to the front panel 127 or the back panel 131. The curved flexible material defining the passage 55 gives the container assembly 125 more rigidity than the flexible pouch would otherwise have, enabling a more upright and free standing container with a taller, skinnier design.

Angled portions 157 are located on the container assembly 125 in an area where the top portion 139 meets the sealed side portions 135, 147. The angled portions 157 begins on a fitment side 159 of the predetermined fold line FL, such that the angled portions 157 are not eliminated by securing the sealed side portions 135, 147 to the front panel 127 or the back panel 131. Including the angled portions 157 reduces the creation of a sharp corner where the smooth sides 137, 153 meet the top portion 139.

To provide further comfort in a consumer's hand, the container assembly 125 as described above is partially disposed within a sleeve (such as sleeve 61 shown in the prior figures), which is found in. The sleeve is made from a strip paper, or other suitable material, secured to itself to form a closed loop having at least one open end. The sleeve is snuggly disposed around the container assembly 125, with the top portion 139 extending from the at least one open end. The sleeve features a second open end opposite the first open end, providing easy manufacturing and assembly of the container assembly 125 within the sleeve. The sleeve can be formed first, and the container assembly 125 inserted into the sleeve, or the sleeve can be formed around the container assembly 125. The sleeve can be secured to the container assembly 125 using adhesive, such as tape or glue, or by any other means known to those skilled in the art. It is appreciated that while the preferred material for the sleeve is paper, any other thin flexible material can be used. The sleeve helps to provide a comfortable consumer interface by further smoothing the exterior of the container assembly 125, increasing the rigidity of the container assembly, and providing a more oval shape without corners or cusps when viewed from the top or bottom of the container assembly 125.

One method, as shown in FIG. 9 (which may also be applied to FIGS. 22-24), to produce the container assembly 125 of the present disclosure involves: providing the flexible pouch at step S1; determining the location of the fold line(s) FL at step S2; applying the adhesive 151 (or a sticker having labeling) to an area 173 of the flexible pouch at step S3; folding the flexible pouch along the fold line(s) FL at step S4; and pressing the side sealed portion(s) 135, 147 onto the area 173 where the adhesive 151 was applied at step S5. Further steps of providing the sleeve with at least one open end 63 at step S6, and inserting the pouch into the sleeve at step S7, may then be performed.

The flexible pouch provided in at step S1 includes the front panel 127 and back panel 131 formed from single or multiple sheets of flexible material, as discussed above. The flexible pouch is sealed around its perimeter, for example along the sides 135, 147, top 139 and bottom 141 portions, and can include the gusset 143 and/or fitment 145. The sealed perimeter includes at least one side sealed portion 135.

To determine where the one or more fold lines FL should be located at step S2, the width W of the side sealed portion(s) 135, 147, and the desired profile of the smooth sides(s) 137, 153 to be formed are taken into account. The fold lines FL should be located far enough from the sealed portion(s) 135, 147 and toward the center of the flexible pouch, such that the sealed portion(s) 135, 147 is not folded or subjected to an excessive amount of stress by being located within the area of the smooth side(s) 137, 153 after the folding ever step has be performed.

Adhesive 151 is applied in the area 173 on the front panel 127 or back panel 131 that is expected to abut the side sealed portion(s) 135, 147 once they have be folded. This area 173 is typically parallel to, and located offset on the more central side of the fold line FL. The adhesive 151 could be applied in a flowable form by nozzle 75 and/or brush application. Additionally, the adhesive 151 could be applied in an aerated form, such as being sprayed on with compressed gas or air, or the adhesive 151 could be applied attached to a secondary medium, such as double sided tape. When applying adhesive 151, care should be taken to apply only so much adhesive 151 as is needed. Excess adhesive 151, and/or adhesive 151 in the wrong spot could interfere with a consumer, for example by sticking to the consumer's hand.

To assist in folding over the flexible pouch, a rod/rail can be provided at step S2.1 and placed along each predetermined fold line(s) FL at step S2.2, thereby helping to produce the smooth side(s) 137, 153 while locating the fold in the right location.

Pressing the side sealed portion(s) 135, 147 against the panel 127, 131 of the flexible pouch in the area 173 where adhesive 151 was applied should be done in a matter that urges the adhesive 151 away from the center of the container assembly 125, thereby causing excess adhesive to flow in the passage 55, where the adhesive 151 will remain free from interference with the consumer. After pressing, the rod/rail, if used, is removed at step S5.1. The rod/rail having been disposed within the passage during pressing but removed thereafter.

Applying adhesive 151 to the flexible pouch, and folding the flexible pouch about the fold line FL, pressing of the side sealed portion(s) 135, 147 to abut the front panel 127 or back panel 131 can be done by hand, or by machine, as further described below.

The present invention is not limited to the details of the above described preferred embodiments. The scope of the invention is defined by the appended claims and all changes and modifications as they fall within the equivalence of the scope of the claims are therefore to be embraced by the invention.

The invention claimed is:

1. A method of forming a container assembly comprising:

providing a flexible pouch having a front panel having an exterior surface, a back panel having an exterior surface, and a side sealed portion, the first side sealed portion;

positioning a first rod over the back portion of the pouch alongside of the side sealed portion;

applying an adhesive to the flexible pouch in an area of the back panel parallel with the rod where the side sealed portion will abut the front panel or back panel when the flexible pouch is folded over the rod;

folding the flexible pouch over the first rod;

pressing the side sealed portion to abut the exterior surface of the back panel, so as to secure the sealed side portion to the back panel with the adhesive; and removing the rod to form a curved profile at a side periphery of the pouch, the curved profile defining an air passage between the adhesive and curved profile.

2. The method of claim 1 further comprising:

the provided flexible pouch having an opposite side sealed portion;

positioning a second rod over the back portion of the pouch between the center portion and opposite sealed portion;

applying an adhesive to the flexible pouch in an area where the opposite side sealed portion will abut the back panel when the flexible pouch is folded over the second rod;

folding the flexible pouch over the second rod; and pressing the opposite side sealed portion to abut the exterior surface of the back panel, so as to secure the sealed side portion to the back panel with the adhesive.

3. A method of forming a container assembly comprising:

providing a flexible pouch having a front panel having an exterior surface, a back panel having an exterior surface, and a side sealed portion, the first side sealed portion;

positioning a first rod over the back portion of the pouch between a center of the pouch and the side sealed portion;

applying an adhesive to the flexible pouch in an area of the back panel where the side sealed portion will abut the front panel or back panel when the flexible pouch is folded over the rod;

folding the flexible pouch over the first rod;

pressing the side sealed portion to abut the exterior surface of the back panel, so as to secure the sealed side portion to the back panel with the adhesive;

providing a sleeve having at least one open end; and disposing the flexible pouch partially in the sleeve with the flexible pouch extending from the at least one open end.

* * * * *